US005709146A

United States Patent [19]

Watanabe

[11] Patent Number: 5,709,146

[45] Date of Patent: Jan. 20, 1998

[54] PROCESS FOR PRODUCING AND PERFORATING AN AQUEOUS SOLVENT SOLUBLE STENCIL PRINTING SHEET

[75] Inventor: Hideo Watanabe, Tokyo, Japan

[73] Assignee: Riso Kagaku Corporation, Tokyo, Japan

[21] Appl. No.: 623,986

[22] Filed: Mar. 29, 1996

Related U.S. Application Data

[63] Continuation of Ser. No. 302,366, Sep. 7, 1994, abandoned.

[30] Foreign Application Priority Data

Sep. 9, 1993 [JP] Japan ..... 5-224724

[51] Int. Cl.[6] ..... B41N 1/24

[52] U.S. Cl. ..... 101/128.21; 101/128.4

[58] Field of Search ..... 101/114, 127, 101/127.1, 128.21, 128.4, 129; 427/143, 273, 336; 156/247, 289, 308.2, 308.6, 308.8, 344

[56] References Cited

U.S. PATENT DOCUMENTS

| | | | |
|---|---|---|---|
| 628,315 | 7/1899 | Haberstroh | 101/128.21 |
| 1,606,217 | 11/1926 | Gestetner | 101/128.21 |
| 4,550,660 | 11/1985 | Sato et al. | 101/128.21 |
| 4,597,829 | 7/1986 | Sato et al. | 101/128.4 |
| 4,961,377 | 10/1990 | Bando et al. | 101/128.21 |
| 5,165,337 | 11/1992 | Schlundt | 101/114 |
| 5,174,203 | 12/1992 | Maeda | 101/114 |

FOREIGN PATENT DOCUMENTS

| | | | |
|---|---|---|---|
| 108509 | 5/1984 | European Pat. Off. . | |
| 1801287 | 4/1969 | Germany . | |
| 11091 | 1/1982 | Japan | 101/128.4 |
| 115898 | 7/1984 | Japan | 101/128.4 |
| 60-67196 | 4/1985 | Japan . | |
| 12387 | 1/1986 | Japan | 101/128.4 |
| 12395 | 1/1986 | Japan . | |
| 21596 | 1/1987 | Japan | 101/128.4 |
| 62-173296 | 7/1987 | Japan . | |
| 255361 | 7/1926 | United Kingdom . | |

*Primary Examiner*—Stephen R. Funk

*Attorney, Agent, or Firm*—Fay, Sharpe, Beall, Fagan, Minnich & McKee

[57] ABSTRACT

A process for producing a stencil printing sheet by laminating a water-soluble resin film to a porous substrate with an adhesive or by heat adhesion. Perforating the water-soluble resin film by a single application of an aqueous solvent onto the water-soluble resin film. The process includes having the aqueous solvent which dissolves the water-soluble resin layer permeate into the interior of the porous substrate.

8 Claims, 1 Drawing Sheet

PROCESS FOR PRODUCING AND PERFORATING AN AQUEOUS SOLVENT SOLUBLE STENCIL PRINTING SHEET

This application is a continuation of Ser. No. 08/302,366, filed on Sep. 7, 1994, now abandoned.

BACKGROUND OF THE INVENTION

1. Field of the Invention

The present invention relates to a process for producing a stencil printing sheet. Specifically, it relates to a process for producing a stencil printing sheet having a solvent-soluble resin layer.

2. Description of the Prior Art

In the prior art, a heat-sensitive stencil sheet is known which is produced by laminating a thermoplastic resin film on a porous substrate with an adhesive. A stencil-making of this heat-sensitive stencil sheet is carried out by means of (1) a process of superposing a hand written or preliminarily prepared manuscript on a heat-sensitive stencil sheet and then perforating by melting a thermoplastic resin film using the heat generated from e.g., flash lamp, infrared lamp, (2) a process of bringing a thermal head which generates a dot-like heat in accordance with electrical signals from letter or picture information, in contact with a heat-sensitive stencil sheet, and perforating by melting a thermoplastic resin film of the sheet, and other processes.

However, according to the stencil-making process described above, it was necessary to experience a complicated process of bringing a manuscript heated by absorbing light or thermal head in contact with a heat-sensitive stencil sheet, conducting the heat to the thermoplastic resin film of a heat-sensitive stencil sheet to melt the thermoplastic resin film and then shrinking the molten material to perforate the thermoplastic resin film, the stencil-making process had the disadvantages in that, for example, (1) a perforating failure was produced by the contacting failure between a thermoplastic resin film and a manuscript which absorbed heat or thermal head; (2) a perforating failure was produced by the nonuniformity in press pressure of a thermal head, resulting in producing wrinkles in a heat-sensitive stencil sheet; (3) the molten material of a thermoplastic resin film was adhered to a thermal head, resulting in producing a conveying failure of a heat-sensitive stencil sheet; and (4) since the molten material was left in a perforated portion, the ink permeability was prevented, resulting in printing failure.

In recent years, a further improvement in quality of a heat-sensitive stencil sheet is demanded. It is demanded to provide such a heat-sensitive stencil sheet that satisfies the smoothness of a thermoplastic resin film, the separating property of the thermoplastic resin film from the manuscript or thermal head, the melting property due to heat, and the shrinkability of a thermoplastic resin film, the adhesive strength between a thermoplastic resin film and a porous substrate, and the mechanical strength and abrasion of the porous substrate, and therefore, the condition for producing a heat-sensitive stencil sheet becomes complicated and there was the problem that the production cost was accordingly increased.

SUMMARY OF THE INVENTION

It is a main object of this invention to solve the above-mentioned problems in the prior art and provide a process for producing a stencil printing sheet in which the production process is easy, the production cost can be lowered and there are no perforating failure at a time of stencil-making, no generation of wrinkles, no conveying failure and no printing failure.

The invention to be claimed mainly in this application will be as follows:

(1) A process for producing a stencil printing sheet by laminating a solvent-soluble resin film to a porous substrate with an adhesive or by heat-adhesion.

(2) A process for producing a stencil printing sheet comprising the steps of:

coating a solvent which dissolves a solvent-soluble resin film to the resin film;

superposing a porous substrate to this coated surface and drying off the superposed surface, to adhere the solvent-soluble resin film to the porous substrate.

Figure 1:
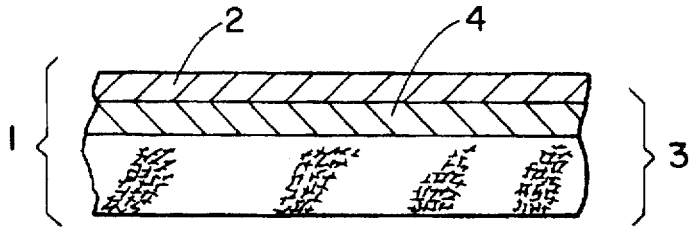
FIG. 1 is a sectional explanatory view showing a stencil printing sheet produced in Example 1 according to the present invention.

In these figures, reference characters 1 to 7 means the following:

1. stencil printing sheet;
2. solvent-soluble resin film;
3. porous substance;
4. adhesive soaked in porous substrate;
5. resin film component permeated on porous substrate surface;
6. heat rollers;
7. ejected solvent;

DETAILED DESCRIPTION OF THE PREFERRED EMBODIMENTS

The detailed description of the present invention will be given specifically with reference to examples in the following. It should be understood, however, that these examples do not limit the scope of the present invention.

A solvent-soluble resin film to be used in this invention contains a thermoplastic or thermosetting resin soluble in water or an organic solvent and others as a main component.

As for a resin soluble in an organic solvent, for example, polyethylene, polypropylene, polyisobutylene, polystyrene, polyvinyl chloride, polyvinylidene chloride, polyvinyl fluoride, polyvinyl acetate, acrylic resin, polyamide, polyimide, polyester, polycarbonate, polyurethane or the like may be used. These resins may be used independently, or in an admixture thereof. Copolymerized form of these resins may be used as well.

As for a water-soluble resin, a resin soluble in water or in water-miscible organic solvent, such as polyvinyl alcohol, methyl cellulose, carboxymethyl cellulose, hydroxyethyl cellulose, polyvinyl pyrolidone, polyethylene-polyvinyl alcohol copolymer, polyethylene oxide, polyvinyl ether, polyvinyl acetal, polyacrylamide or the like may be used. These resins may be used independently, or in an admixture thereof. Copolymerized form of these resins may be used as well.

In addition to the above resin components, dyestuffs, pigments, fillers, binders, hardeners and others can be also contained in the solvent-soluble resin film described above.

The thickness of the solvent-soluble resin film is preferably in the range of 0.1 μm–100 μm, and more preferably, in the range of 1 μm–50 μm. When the thickness thereof is less than 0.1 μm, the strength of the resin film becomes insufficient and when it exceeds 100 μm, a large quantity of the solvent which dissolves the resin film may be required and the dissolution of the resin film often becomes insufficient.

As for a porous substrate to be used in the invention, Japanese paper or the like, woven or nonwoven cloth, gauze or the like made from natural fiber such as Manila hemp, pulp, Mitsumata (Edgeworthia papyrifera Sieb.), Kozo (Broussonetia kazinoki Sieb.), synthetic fiber such as that of polyester, nylon, vinylon, acetate fiber or the like, a thin leaf paper using metallic fiber, glass fiber or the like, independently or as a mixture thereof, can be exemplified. Each basis weight of these porous substrate is preferably in the range of 1 $g/m^2$–20 $g/m^2$, and more preferably, in the range of 5 $g/m^2$–15 $g/m^2$. When each basis weight is less than 1 $g/m^2$, the strength of the sheet becomes weak, and when it exceeds 20 $g/m^2$, the ink permeability often becomes bad at a printing time. Also, the thickness of the porous substrate is preferably in the range of 5 μm–100 μm, and more preferably, in the range of 10 μm–50 μm. When the thickness is less than 5 μm, the strength of the sheet still becomes weak, and when it exceeds 100 μm, the ink permeability at a printing time often becomes bad.

For laminating a solvent-soluble resin film to a porous substrate, a process (1) of using an adhesive, a process (2) of applying a heat-adhesion to a resin film and a porous substrate or a process (3) of coating a solvent which dissolves a resin film to the solvent-soluble resin film, superposing a porous substrate on the coated surface and drying the superposed surface, can be adapted.

In the process (1), a solvent-soluble type or water-dispersion type adhesive is coated on a resin film or porous substrate and then cured thermally or photolytically as to be laminated to each other. A heat-adhesion may be made using a hot-melt type adhesive to laminate to each other. As for such an adhesive, the coated film after curing or heat-adhesion is preferably soluble in such a solvent that dissolves the resin film described above. For example, epoxy resin, phenolic resin, vinyl acetate, ethylene-vinyl acetate copolymer, vinyl chloride-vinyl acetate copolymer, acrylic resin, polyester, polyurethane, styrene-butadiene copolymer, polyisobutylene, polyisoprene, butyl rubber, polyacrylamide, rosin, terpene, polystyrene or the like can be used. Furthermore, a hardener, softener, adhesive adder, filler and others may be mixed therewith to be used, if necessary.

The process (2) can be adapted in the case when thermally molten components are contained in a resin film and/or a porous substrate. In this case, the resin film is laminated to the porous substrate by means of a heating apparatus such as a heat roller and others.

The process (3) makes use of the characteristics of a solvent-soluble resin film which dissolves in a solvent. Since the dissolved surface of the resin film has an adhesive function, the process becomes simple and the production cost can be reduced. As for a solvent, such a solvent that dissolves the resin film which will be described later may be used, and this solvent is coated wholly or partially on the one side surface of the resin film. Then, a porous substrate is superposed to this surface and the superposed surface is dried, resulting in laminating to each other.

Since the stencil printing sheet produced by the above process has a solvent-soluble resin film, once the resin film is brought in contact with a solvent which dissolves the resin film, the resin component in the contacted portion starts dissolving into the solvent and then, the resin dissolves in the solvent up to its saturation in solubility. The solution which dissolved the resin permeates into a porous substrate and the resin film corresponding to this portion is perforated. Since the solution which dissolved the resin film permeates into the porous substrate, the dissolved component is not left in the perforated portion of the resin film and does not obstruct the perforation. In addition, the perforating property of the resin film can be adjusted by controlling the solubility of the solvent to the resin film and the quantity of the contacting solvent. As for a solvent which dissolves the solvent-soluble resin film, each type solvent, such as aliphatic hydrocarbons, aromatic hydrocarbons, alcohols, ketones, esters, ethers, aldehydes, carboxylic acids, carboxylic esters, amines, low molecular heterocyclic compounds, oxides or water, can be exemplified. Specifically, hexane, heptane, octane, benzene, toluene, xylene, methyl alcohol, ethyl alcohol, isopropyl alcohol, n-propyl alcohol, butyl alcohol, ethylene glycol, diethylene glycol, propylene glycol, glycerine, acetone, methyl ethyl ketone, ethyl acetate, propyl acetate, ethyl ether, tetrahydrofuran, 1,4-dioxane, formic acid, acetic acid, propionic acid, formaldehyde, acetaldehyde, methylamine, ethylenediamine, dimethylformamide, pyridine, ethylene oxide and the like are preferable. These solvents can be used independently or in an admixture thereof. Furthermore, dyestuffs, pigments, fillers, binders, hardeners, antiseptics, wetting agents, surfactants, pH conditioners and others can be contained in the solvent.

The stencil-making of the stencil printing sheet described above may be carried out by either bringing a means, such as a brush pen soaked in a solvent, in contact with a solvent-soluble resin film directly, but it is preferable to feed the solvent to the resin film by a solvent ejecting device or the like in a non-contact condition so as to perforate and carry out the stencil-making of the stencil printing sheet.

As for a solvent ejecting device, there is exemplified such an apparatus that a nozzle, a slit, an injector, a porous material, a porous film or the like is connected to a liquid feed pump, a piezoelectric element, or a heating element so as to release the solvent intermittently or continuously in a dot or in a line form corresponding to each letter and picture signal. Since this kind of process makes it possible to carry out the stencil-making of stencil printing sheet in a non-contact condition with aid of a stencil-making apparatus, there is no generation of wrinkles at a time of stencil-making. Also, differently from a conventional heat-sensitive stencil sheet, no molten material is left in the perforated portion and a brilliant printed matter can be obtained.

Furthermore, the stencil printing sheet of the invention can be produced without need of any separating property, abrasion and mechanical strength as required in the conventional heat-sensitive stencil sheet.

The stencil printing sheet obtained by the process of the invention can be applied to a general stencil printing process to obtain a printed matter. For example, a printed matter can be obtained by mounting an ink on a perforated stencil printing sheet, passing the ink through each portion perforated by press rolls, reduced pressure means or squeegee rolls, and transcribing the ink to a printing paper. As a printing ink, an oily ink usually used in stencil printing, water-base ink, water-in-oil emulsion ink, oil-in-water emulsion ink, and others can be used.

The present invention will be explained in detail by the following examples. It should be understood, however, that these examples do not limit the scope of the present invention.

EXAMPLE 1

An adhesive solution consisting of the following composition was coated on a polyester fiber cloth having a sieve opening of 200 mesh and dried off. Then, a polyvinyl alcohol film of 10 μm in thickness was superposed on this coated surface and then left in a thermostart at 40° for two days to give a stencil printing sheet. The sectional view of the stencil printing sheet was shown in FIG. 1, wherein 1 indicates a stencil printing sheet, 2 indicates a polyvinyl alcohol film (solvent-soluble resin film), 3 indicates a polyester fiber cloth (porous substrate), 4 indicates an adhesive soaked in the porous substrate, respectively.

| | |
|---|---|
| Polyurethane (solid content 30% by weight) | 50 parts by weight |
| Isocyanate | 5 parts by weight |
| Ethyl acetate | 25 parts by weight |
| Toluene | 20 parts by weight |

An aqueous solution consisting of the following composition was ejected in a letter shape to the stencil printing sheet described above from an ejecting means provided with a nozzle of 8 dots/mm and a piezoelectric element connected thereto, and the polyvinyl alcohol film at the ejected portion was dissolved and perforated.

| | |
|---|---|
| Isopropyl alcohol | 20 parts by weight |
| Ethylene glycol | 10 parts by weight |
| Water | 70 parts by weight |

Then, a black offset ink was mounted on the polyester fiber cloth of the engraved stencil printing sheet, and this sheet was superposed on a printing paper. When the ink was squeezed by a blade, the similar letters as shown in the perforated portions were brilliantly printed.

EXAMPLE 2

An adhesive solution consisting of the following composition was coated on a polyester fiber cloth having a sieve opening of 200 mesh and dried off. Then, a polycarbonate film of 6 μm in thickness was superposed on this coated surface to give a stencil printing sheet.

| | |
|---|---|
| Acrylic emulsion adhesive (solid content 50% by weight) | 50 parts by weight |
| Water | 50 parts by weight |

A mixed solvent consisting of the following composition was ejected in a letter shape to the stencil printing sheet described above from the ejecting means used in Example 1, and the polycarbonate film in the ejected portion was dissolved and perforated.

| | |
|---|---|
| Methyl ethyl ketone | 50 parts by weight |
| Toluene | 30 parts by weight |
| Isopropyl alcohol | 20 parts by weight |

Subsequently, a black ink (HI-MESH, trademark of Riso Kagaku Corporation) for use in a portable stencil printing device (PRINT GOKKO PG-10, trademark of Riso Kagaku Corporation) was mounted on the polyester fiber cloth of the engraved stencil printing sheet, and this was superposed on a printing paper to carry out printing by means of PRINT GOKKO PG-10, resulting in printing brilliantly the similar letters to those of the perforated portions.

EXAMPLE 3

The same resin solution as that of Example 2 was coated on a Japanese paper having a basis weight of 10 g/m$^2$ and dried off. Then, a polyethylene oxide film of 15 μm in thickness was superposed on this surface to give a stencil printing sheet.

In the similar manner as shown in Example 1, a stencil-making was carried out to this stencil printing sheet to print, resulting in obtaining a good printed matter.

EXAMPLE 4

Figure 2:
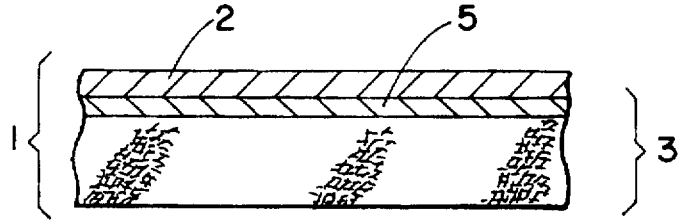
FIG. 2 is a sectional explanatory view showing a stencil printing sheet produced in Example 4 according to the present invention.

The aqueous solution used in the stencil-making of Example 1 was coated on a polyethylene oxide film of 15 μm in thickness and a Japanese paper having a basis weight of 10 g/m$^2$ was superposed on this coated film before this solution was dried off. Then, the superposed film was dried to give a stencil printing sheet. The section of the stencil printing sheet thus obtained is shown in FIG. 2. In the drawing, 5 indicates a resin film component dissolved and soaked in the surface of a porous substrate.

The aqueous solution used in the stencil-making of Example 1 was ejected in a letter shape to this stencil printing sheet from an ejecting means provided with a nozzle of 12 dots/mm and a heating element, and the polyethylene oxide film at the ejected portion was dissolved and perforated.

Then, a black offset ink was mounted on the polyester fiber cloth of the engraved stencil printing sheet and this was superposed on a printing paper. When the ink was squeezed by a blade, the similar letters as shown in those of the perforated portion were brilliantly printed.

EXAMPLE 5

Figure 3:
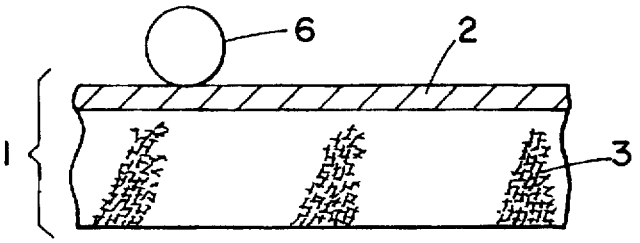
FIG. 3 is an explanatory view showing a production of the stencil printing sheet in Example 5 according to the present invention.
Figure 4:
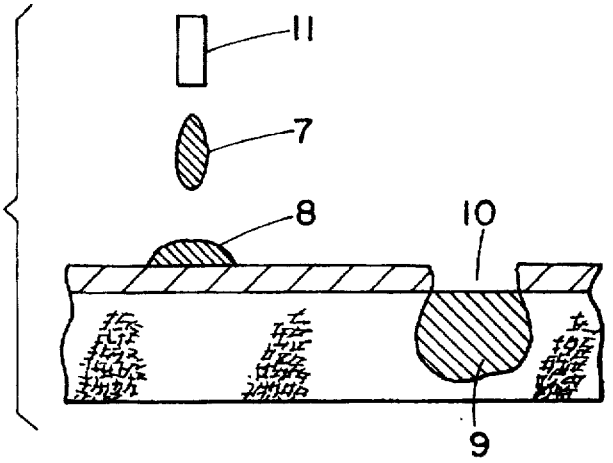
FIG. 4 is an explanatory view showing a perforation of the stencil printing sheet produced in Example 5.

A polyvinyl ether film of 20 μm in thickness was laminated to a Japanese paper having a basis weight of 10 g/m$^2$ by superposing to each other and passing it through heat rollers at 120° to give a stencil printing sheet. In the similar manner as shown in Example 4, the stencil-making of this stencil printing sheet was made and a printing was carried out, resulting in obtaining a good printed matter. The explanatory view showing a production of the stencil printing sheet is given in FIG. 3 and the explanatory view showing a perforation is given in FIG. 4. In the drawings, 6 indicates heat rollers, 7 and 8 indicate solvents, 9 indicates a resin solution soaked in a porous substrate, 10 indicates a perforated portion and 11 indicates an ejecting means, respectively.

EFFECTIVESNESS OF THE INVENTION

According to the production process of the invention, as a solvent-soluble resin film is laminated directly to a a porous substrate, the production cost can be reduced. Since the stencil printing sheet obtained by the production process of the invention can be perforated by a solvent in its non-contact condition, there is no generation of any perforating failure at a time of stencil-making, any wrinkles and conveying failure, and it is possible to print brilliant pictures thereby.

What we claim is:

1. A process for producing a stencil printing sheet which comprises the step of laminating a water-soluble resin film to a porous substrate with an adhesive or by heat adhesion, and the step of perforating the water-soluble resin film by a single application of an aqueous solvent onto the water-soluble resin film, wherein the aqueous solvent which dissolves the water-soluble resin layer permeates into an interior of the porous substrate, and the step of controlling (i) the solubility of the aqueous solvent to the resin film, and (ii) the quantity of the aqueous solvent to thereby cause the aqueous solvent to be retained within the interior of the porous substrate during the process.

2. A process for producing a stencil printing sheet according to claim 1, wherein said water-soluble resin is selected from polyvinyl alcohol, polyethylene oxide and polyvinyl ether, polyvinyl acetal.

3. A process for producing a stencil printing sheet according to claim 1, wherein said resin film has a thickness in the range of 0.1 to 100 μm.

4. A process for producing a stencil printing sheet according to claim 1, wherein said porous substrate is selected from a polyester fiber cloth or a Japanese paper having a basis weight in the range of 1 to 20 $g/m^2$ and a thickness in the range of 5 to 100 μm.

5. A process for producing a stencil printing sheet comprising the steps of:

coating an aqueous solvent which dissolves a water-soluble resin film on said film;

superposing a porous substrate on the coated surface and drying off the superposed surface, to impregnate the dissolved water-soluble resin film into said porous substrate; and perforating the water-soluble resin film by a single application of an aqueous solvent onto the water-soluble resin film, wherein the aqueous solvent which dissolves said water-soluble resin film, permeates into an interior of the porous substrate.

6. A process for producing a stencil printing sheet according to claim 5, wherein said water-soluble resin is selected from polyvinyl alcohol, polyethylene oxide and polyvinyl ether, polyvinyl acetal.

7. A process for producing a stencil printing sheet according to claim 5, wherein said resin film has a thickness in the range of 0.1 to 100 μm.

8. A process for producing a stencil printing sheet according to claim 5, wherein said porous substrate is selected from a polyester fiber cloth or a Japanese paper having a basis weight in the range of 1 to 20 $g/m^2$ and a thickness in the range of 5 to 100 μm.

* * * * *